US011158974B2

(12) United States Patent
Architekt et al.

(10) Patent No.: US 11,158,974 B2
(45) Date of Patent: Oct. 26, 2021

(54) ELECTRICAL CONNECTOR HOUSING COMPATIBLE WITH TWO TERMINAL TYPES

(71) Applicant: APTIV TECHNOLOGIES LIMITED, St. Michael (BB)

(72) Inventors: Rafal Architekt, Pacanów (PL); Pawel Kot, Trzyciaz (PL); Mateusz Lyson, Cracow (PL)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/781,008

(22) Filed: Feb. 4, 2020

(65) Prior Publication Data

US 2020/0251845 A1 Aug. 6, 2020

(30) Foreign Application Priority Data

Feb. 6, 2019 (EP) ..... 19155813

(51) Int. Cl.
*H01R 13/432* (2006.01)
*H01R 13/422* (2006.01)
(Continued)

(52) U.S. Cl.
CPC ..... *H01R 13/432* (2013.01); *H01R 13/422* (2013.01); *H01R 4/18* (2013.01);
(Continued)

(58) Field of Classification Search
CPC .... H01R 13/18; H01R 13/187; H01R 13/113; H01R 13/111; H01R 13/11; H01R 13/114;
(Continued)

(56) References Cited

U.S. PATENT DOCUMENTS 4,285,562 A 8/1981 Teagno et al.
4,753,605 A 6/1988 DeYoung
(Continued)

FOREIGN PATENT DOCUMENTS

CN 102934291 A 2/2013
DE 202011000947 U1 10/2011

OTHER PUBLICATIONS

China Patent Application No. 202010079554.0, First Notification of Office Action dated Jan. 4, 2021.

*Primary Examiner* — Abdullah A Riyami
*Assistant Examiner* — Justin M Kratt
(74) *Attorney, Agent, or Firm* — Carlson, Gaskey & Olds, P.C.

(57) ABSTRACT

An electrical connector housing has a plurality of socket cavities configured to receive single terminal inserts or bus inserts introduced from a rearward section. At least one row of socket cavities is formed as cylindrical cavities extending in the housing in parallel manner along an insertion direction running from the rearward to the forward section. Adjacent cavities in the row are separated by a partition wall. First locking means are provided in the socket cavities for locking in place a single terminal insert arranged in a given cavity. Second locking means are provided for locking in place a bus insert inserted in a corresponding number of socket cavities. The partition walls comprise, in the rearward section, slots extending in the insertion direction to accommodate the bus plate of the bus insert.

12 Claims, 4 Drawing Sheets

(51) Int. Cl.

| | |
|---|---|
| *H01R 13/629* | (2006.01) |
| *H01R 4/18* | (2006.01) |
| *H01R 13/627* | (2006.01) |
| *H01R 13/24* | (2006.01) |
| *H01R 11/05* | (2006.01) |
| *H01R 13/11* | (2006.01) |
| *H01R 25/00* | (2006.01) |
| *H01R 13/17* | (2006.01) |
| *H01R 13/40* | (2006.01) |
| *H01R 11/32* | (2006.01) |
| *H01R 13/502* | (2006.01) |
| *H01R 13/46* | (2006.01) |
| *H01R 13/50* | (2006.01) |
| *H01R 31/08* | (2006.01) |
| *H01R 13/187* | (2006.01) |
| *H01R 101/00* | (2006.01) |
| *H01R 13/18* | (2006.01) |
| *H01R 13/115* | (2006.01) |
| *H01R 4/48* | (2006.01) |

(52) U.S. Cl.

CPC ..... *H01R 4/185* (2013.01); *H01R 4/4818* (2013.01); *H01R 11/05* (2013.01); *H01R 11/32* (2013.01); *H01R 13/11* (2013.01); *H01R 13/111* (2013.01); *H01R 13/112* (2013.01); *H01R 13/113* (2013.01); *H01R 13/114* (2013.01); *H01R 13/115* (2013.01); *H01R 13/17* (2013.01); *H01R 13/18* (2013.01); *H01R 13/187* (2013.01); *H01R 13/2407* (2013.01); *H01R 13/40* (2013.01); *H01R 13/4223* (2013.01); *H01R 13/46* (2013.01); *H01R 13/50* (2013.01); *H01R 13/502* (2013.01); *H01R 13/627* (2013.01); *H01R 13/629* (2013.01); *H01R 25/00* (2013.01); *H01R 31/085* (2013.01); *H01R 2101/00* (2013.01)

(58) Field of Classification Search

CPC ..... H01R 13/115; H01R 2101/00; H01R 4/4818; H01R 13/17; H01R 4/18; H01R 13/46; H01R 13/50; H01R 13/2407; H01R 13/4223; H01R 31/085; H01R 13/432; H01R 13/422; H01R 13/112; H01R 11/32; H01R 4/185; H01R 11/05; H01R 25/00; H01R 13/502; H01R 13/40; H01R 13/627; H01R 13/629

USPC ..... 439/691, 839

See application file for complete search history.

(56) References Cited

U.S. PATENT DOCUMENTS

| | | | | |
|---|---|---|---|---|
| 6,231,355 | B1 * | 5/2001 | Trammel | H01R 13/6585 439/79 |
| 7,361,065 | B1 * | 4/2008 | Hardy | H01M 8/0247 439/856 |
| 2014/0004747 | A1 * | 1/2014 | Yu | H01R 31/085 439/626 |

* cited by examiner

ELECTRICAL CONNECTOR HOUSING COMPATIBLE WITH TWO TERMINAL TYPES

CROSS REFERENCE TO RELATED APPLICATION

This application claims priority to European Patent Application No. EP 19155813.9, which was filed on Feb. 6, 2019.

TECHNICAL FIELD

The present invention generally relates to an electrical connector, and more particularly to an electrical connector housing comprising socket cavities with electrical contact inserts arranged therein.

BACKGROUND

In the automotive field, connector boxes or more generally connector housings are provided to realize electric connections between components and/or wires.

An electric connector housing is made of electrically insulating material, generally plastic, and accommodates in a socket cavity a conductive element, referred to as contact insert, configured to allow an electric connection between a front side and a rear side of the housing. The contact insert may have a female connector section for receiving a terminal, a flat connector section that can be fixed to a PCB card, a crimp connector section to receive a wire or any other type of connector section depending on the needs of a particular application. The contact insert is introduced into a cavity of the connector housing and locked therein.

A conventional design of connector housing comprises a plurality of sockets formed by cavities in the housing body wherein each cavity is configured to receive a contact insert therein. A socket is essentially a compartment with lateral walls and generally comprises a plurality of locking elements provided integrally with the side walls. After being inserted in its socket, a contact is locked in place by means of the locking elements that oppose its removal. Additional stops may be formed in front of each socket in order to limit the movement of the contact insert.

To minimise risks of a contact insert being pulled out of its socket by a transversal force, it is preferred that the contact insert is shaped and sized to fit tightly into the cavity. As a result, electric connector housings as they are currently known in the art have socket cavities shaped for accommodating a predetermined type of contact insert.

Embodiments of the present invention provide an improved design of connector housing that allows for more flexibility in the use of the connector housing and hence is adapted for a variety of applications.

SUMMARY

The present invention relates, in a first aspect, to an electrical connector housing comprising an electrically insulating housing body with a plurality of socket cavities therein. According to an important aspect of the invention, the present housing, respectively its socket cavities, are configured to receive therein contact inserts of a first type or of a second type.

The first type of contact insert, referred to as single terminal insert, is formed as an elongate conductor designed to engage in a single socket. The second type of contact insert, referred to as bus insert, comprises a number of spaced apart, parallel contact terminals extending from a bus plate, and designed so that the terminals engage in a corresponding number of sockets aligned in a row.

The electrical connector housing comprises:

- a forward section for connecting terminals of electrical components to the contact inserts arranged inside the housing;
- an opposite rearward section from which the contact inserts are inserted into the cavities;
- at least one row of socket cavities formed as cylindrical cavities extending in the housing in parallel manner along an insertion direction running from the rearward to the forward section, adjacent cavities in the row being separated by a partition wall;
- first locking means provided in the socket cavities for locking in place a single terminal insert arranged in a given cavity;
- second locking means provided for locking in place a bus insert inserted in a corresponding number of socket cavities; and
- in the rearward section, slots arranged in the partition walls and extending in the insertion direction to accommodate the bus plate of the bus insert.

The present invention thus proposes an electrical connector housing that is designed to be compatible with two types of contact inserts that can be introduced alternatively in same socket cavities. This allows for a greater variety of uses of the electrical connector housing and reduces the diversity of parts, e.g. in the automotive field.

Separate locking means are provided in the housing for each of the two types of contact inserts. The locking means are designed to cooperate with the contact insert to lock them in place in the cavities. Any appropriate design of locking means can be used, including elastic or form-fitting.

The spanning of the bus plate of the bus insert across several cavities requires some particular design: slots are therefore provided in the partition walls to accommodate therein the bus plate. These slots extend from the rear end of the partition wall through its entire thickness, so that the bus plate can pass from one cavity to the neighboring cavity. The slots preferably have a width corresponding to the thickness of the bus plate. This narrow design of the slots avoids deflection of the bus plate in the direction perpendicular to the plane of the bus plate. A more robust locking/fixation of the bus insert is thus obtained.

In embodiments, the first locking means comprise a pair of protrusions arranged on opposite cavity walls (preferably in facing relationship) and each defining a substantially transverse locking surface facing frontward, for abutment by elastic tabs extending outwardly from the single terminal insert, when locked in place in the cavity.

Advantageously, an axially extending recess is formed along each of the opposite walls, beyond the protrusions in insertion direction, for receiving and guiding the single terminal insert therein.

The first locking protrusions preferably include an axially extending groove for allowing passage of the bus inserts through the protrusions towards the forward section. With these axial grooves, the first locking protrusions also allow for guiding and positioning the terminals of the bus insert in the rearward section of the housing. The width of the groove accordingly preferably matches the thickness of the terminals.

In embodiments, the second locking means are located in the rearward section of the cavity. The second locking means may comprise a recess in a cavity wall defining an abutment surface substantially perpendicular to the insertion direction, that cooperates with a resilient locking tab protruding out from the bus plate.

According to another aspect of the invention, there is proposed a bus insert, in particular for co-operation with the electrical connector housing disclosed herein, which is made from electrically conductive sheet metal and comprises: a substantially rectangular base plate having opposite longitudinal edges; and a number of spaced apart, parallel contact terminals extending from a first longitudinal edge of the bus plate, each terminal including an intermediate section connected at one end to the bus plate and at the other end to a terminal section. The intermediate section of each terminal is bent out of the plane of the bus plate in such a way that the terminal sections of the terminals lie in a plane parallel to, but spaced from the plane of the bus plate.

Such design of the bus insert, with bent terminals, is very convenient for insertion in an electrical connector housing also compatible with single terminal inserts, since the bends permits improving the compactness of the assembly.

For connection purposes, a connector section preferably extends from the second longitudinal edge of said bus plate, for securing an electric wire thereto. This is however not required and other types of interface may be provided to connect the bus plate to a wire or other electrical component.

In embodiments, at least one resilient tab protrudes outwardly from the bus plate, the resilient tab being connected at one end to the bus plate and having its free end extending outwardly in direction of the second longitudinal edge, over a corresponding aperture in the bus plate in which it can fit. The resilient tab acts as locking tab and is configured to normally protrude outwardly from the plane of the insert plate. Thanks to its resilience, the tab can be folded back in the plane of the insert plate during insertion of the bus insert into the cavities, and retrieves spontaneously its outward position.

In embodiments, the terminal section of each terminal is U-shaped and comprises a pair of arms extending along the terminal axis and spaced by a groove. The end portion of the terminals thus forms a female connector that will, in use, be arranged in the frontward section of the housing, and facilitate connection to electric components plugged into the housing.

According to a third aspect, the invention concerns a kit of parts for an electrical connector comprising an electrical connector housing as disclosed herein, at least one bus insert as disclosed herein and a plurality of single terminal inserts formed as elongate conductors designed to engage in a single socket cavity of the housing.

BRIEF DESCRIPTION OF THE DRAWINGS

Further details and advantages of the present invention will be apparent from the following detailed description of not limiting embodiments with reference to the attached drawings, wherein.

DETAILED DESCRIPTION

Figure 1:
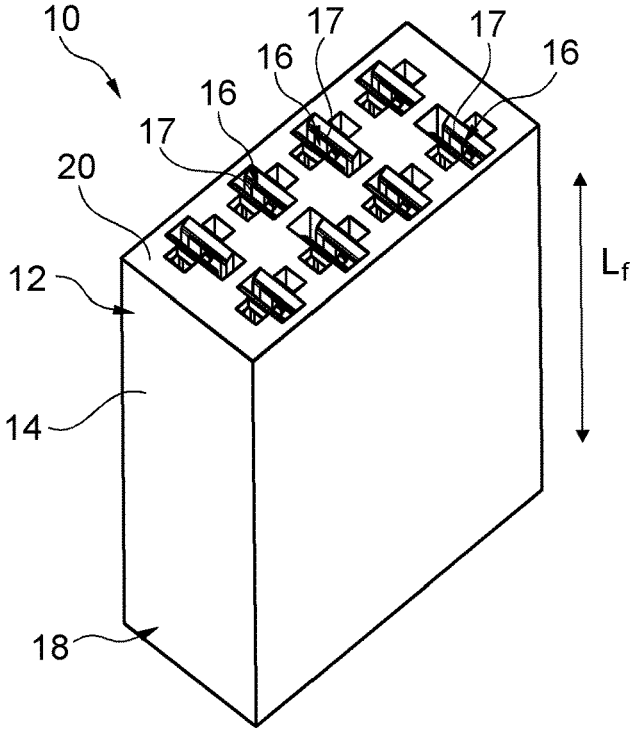
FIG. 1: is a perspective view of an embodiment of the present electrical connector housing, seen from the forward section.

An embodiment of the present electric connector housing 10 is shown in FIG. 1, with the frontward section 12 on top. In this embodiment, the housing 10 has a body 14 of generally parallelepiped shape and includes a plurality of socket cavities 16 designed to receive conductive contact inserts therein. The contact inserts provide an electrical connection between the frontward 12 and rearward 18 sections of the housing. In the frontward section 12 the cavities 16 are open and configured to form a contact area for terminals of an electrical component—not shown, e.g. a fuse, a shunt or another component. Inserting the electrical component into two cavities 16 from the front face 20 will establish contact between that electrical component and the contact inserts arranged inside the housing. At the opposite, rearward section 18, the contact inserts are connected to any appropriate conductor or circuit or other component.

In the present embodiment, housing 10 comprises eight socket cavities 16, which in the frontward section 12 end with apertures 17 configured to receive the terminals of electrical fuses. The housing body 14 is made of an electrically insulating material, generally a polymer, e.g. PBT GF30.

It will be appreciated that the present housing 10 is designed to be compatible with two types of metallic contact inserts that can be assembled inside the socket cavities.

These contact inserts will now be described in detail before focusing on the construction of the housing.

Figure 3:
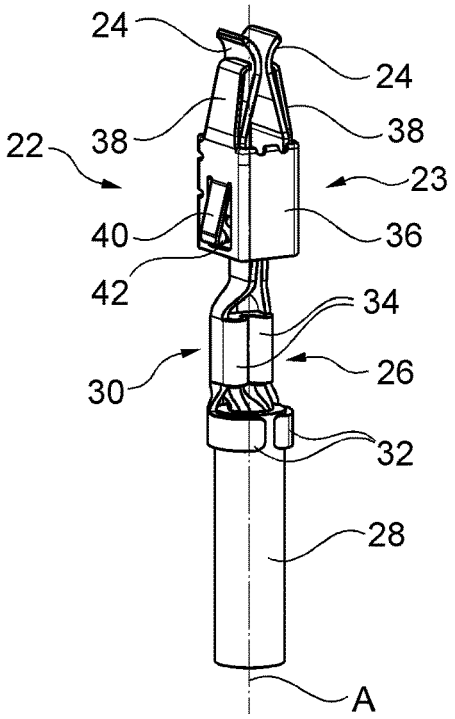
FIG. 3: is a perspective view of a single terminal insert.

The first type of contact insert 22, referred to as single terminal insert, is shown in FIG. 3. It is formed as an elongate conductor element—extending along a longitudinal axis A—that is designed to engage in a single socket cavity. One end of the single terminal insert 22 is designed as female connector section 23 and comprises a pair of resilient arms 24 extending in longitudinal direction from a centre section of the conductor element. The two arms 24 are flat blades arranged in a symmetrical manner along the longitudinal direction and adapted to receive and clamp between them a terminal (or pin, or the like) of an electrical component. In use, these arms 24 are located in the frontward section 12 of the housing 10 and thus permit connection to the component plugged in from the frontward section, through aperture 17.

Opposite the female connector section 23, the single terminal insert 22 comprises a crimping section 26 that is shown in FIG. 3 with a wire 28 attached thereto. The crimping section 26 comprises a fixation crimp barrel 30 formed by a U-shaped portion with two arms 32 clamped around the insulating sheath of wire 28 for fixedly connecting the wire to the contact insert 22. The crimping section 26 also includes a pair of conductive arms 34 clamped around the conductor(s) of wire 28 to allow electric connection with the contact insert 22. In use, this crimping side 26 of the single connector is located in the rearward section.

Between the crimping section 26 and the female connector section 23, the contact insert 22 comprises a cylinder 36 with a square base fitted over the arms 24. The cylinder 36 has an outer shape corresponding to the internal shape of the cavity 16 of the connector housing 10 to facilitate the assembly of the single terminal insert 22.

The resilient arms 24 are integral with the crimping section 26 and extend axially out of the cylinder 36, from two opposite sides. A pair of rigid arms 38 extend in same direction from the same opposite cylinder sides, in order to limit the spreading apart of the resilient arms 24.

Still to be noted in FIG. 3, a pair of resilient tabs 40 protrude outwardly laterally from the cylinder 36, on the same side as the rigid arms 38. Tabs 40 are connected at one end to cylinder 36 and extend in the longitudinal direction away from the cylinder in direction of the crimping section. The tabs 40 are typically cut out in the material of the cylinder 36 and thus coincide with an opening 42 in the cylinder 36, in which they can fit, so that the tabs 40 are flush with the surface of the cylinder 36. Theses tabs 40 serve as locking elements for fixing the single terminal insert inside the housing, as will be discussed below. The tabs 40 are bent outwardly (rest position) but thanks to their resilience they can be temporarily moved into openings 42 during the assembly process.

Figure 4:
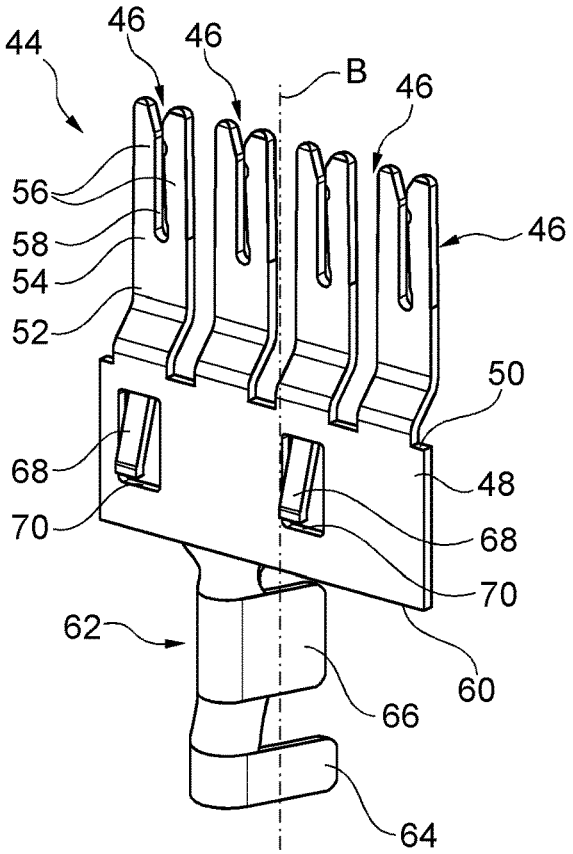
FIG. 4: is a perspective view of a bus insert.

The second type of contact insert, referred to as bus insert 44, is shown in FIG. 4 and comprises a number of spaced apart, parallel contact terminals 46 extending from a bus plate 48. Bus insert 44 is designed so that the terminals 46 engage in a corresponding number of socket cavities 16 aligned in a row.

The bus insert 44 is a one piece element made from a metallic sheet that is cut to provide the desired configuration. Any suitable electrically conductive metals may be used, e.g. copper alloy (C19400 or other).

As depicted, the bus insert 44 has a longitudinal extension along axis B and comprises an essentially rectangular bus plate 48, extending transversally to axis B, and a set of four contact terminals 46 that extend from a same transverse edge 50 of the bus plate 48 in direction of axis B. The terminals 46 are separated by an equal space. Each terminal 46 is here configured as female terminal and comprises a strip like intermediate section 52 connected at one end to the bus plate 48 and at the other end to a terminal, U-shaped section 54. The U-shaped section 54 comprises two arms 56 extending along axis B and spaced by a groove 58. In use, the terminals 46 are located in the frontward housing section 12. Accordingly, the inner edges of the arms 56 are provided with a predetermined inner profile in accordance with the design of the terminals of the electrical component to be inserted therein, in particular to provide a clamping effect.

On the bus plate edge 60 opposite the terminals 46 is provided a crimping section 62 similar to the one of the single terminal insert 22, but shown in an open state without wire attached to it. Crimping section 62 includes a U-shaped portion with a first pair of arms 64 to be bent as crimping barrel around the insulating sheath of a wire, not shown. It also comprises a second pair of arms 66 that are, in use, clamped around the conductor(s) of the wire, not shown.

Advantageously, for increased compactness of the assembly, the terminals 46 of the bus insert 44 are bent. That is, the intermediate section 52 of the terminals 46 include two bends such that the U-shaped sections 54 lie in a plane different, but substantially parallel, to the plane of the bus plate 48.

It may be noted that the bus plate 48 further comprises two resilient tabs 68 that serve as locking elements, as will be discussed below. Tabs 68 are connected at one end to bus plate 48 and extend in the longitudinal direction B away from the plate in direction of the crimping section 62 (or opposite from the terminals 46). The tabs 48 are typically cut out in the material of the plate 48 and thus coincide with an opening 70 in the plate 48, in which they can fit during the assembly process, so that the tabs 48 can be flush with the surface of the bus plate 48.

Still to be noted, the terminals 46 and the crimping section 62 extend on a same side of the bus plate 48, which is opposite to the side from which tabs 68 protrude.

Figure 2:
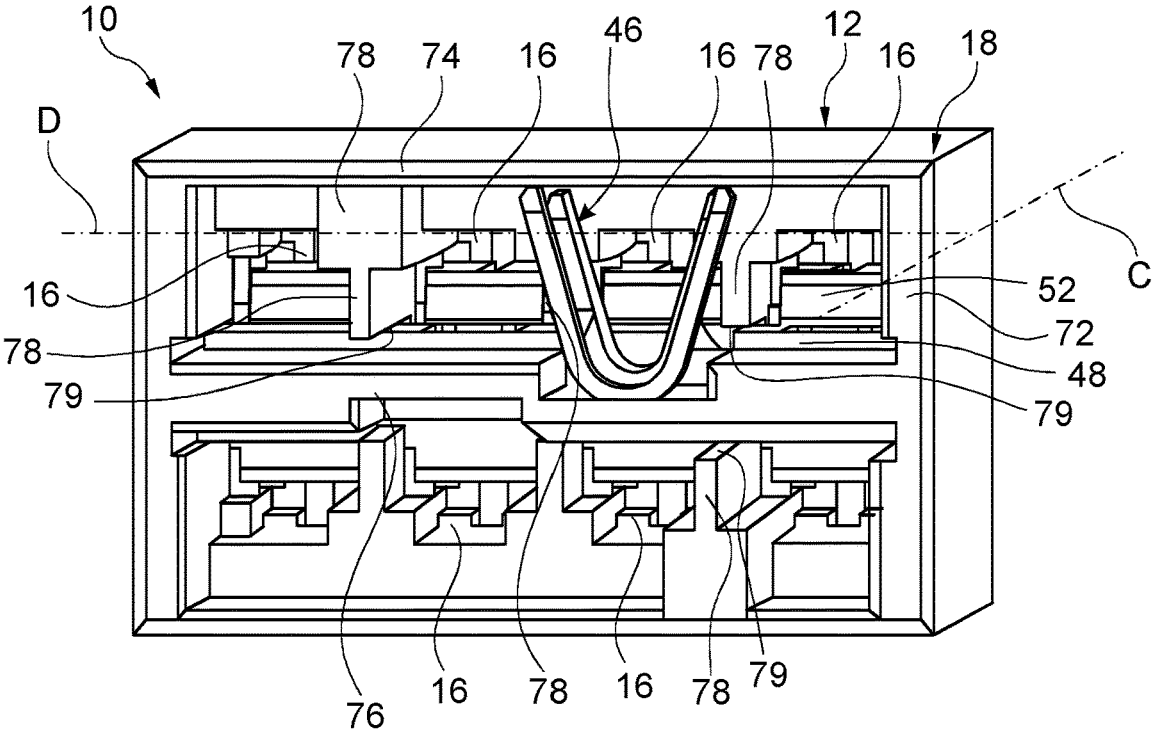
FIG. 2: is a perspective view of the housing of FIG. 1, seen from the rearward section, wherein a bus insert is located in the cavities of the first row.

Let us now turn to FIG. 2, which shows the rearward section 18 of the housing 10, which end face 70, from which the contact inserts 22, 44, are introduced into the socket cavities 16. One will recognise the eight cavities 16 arranged in two rows of four. As can be seen, the four cavities 16 in the upper row receive the bus insert 44 of FIG. 4. However, these four cavities 16 are also configured to alternatively receive therein four single terminal inserts 22 of FIG. 3.

The socket cavities 16 are formed as cylindrical cavities extending in the housing 10 in parallel manner along the insertion direction running from the rearward 18 to the forward 12 section, indicated generally by axis C in FIG. 2.

The contact inserts 22, 44 are designed to be easily inserted inside a respective socket cavity 16 and to be locked therein.

Accordingly, each socket cavity 16 comprises first locking means for locking in place a single terminal insert and second locking means for locking in place bus inserts.

The cavities in the top row are all functionally identical in order to accommodate both types of inserts. Accordingly, from the design perspective, each cavity is seen as a tubular cell unit having four walls and defining the inner socket cavity.

Referring to FIG. 2, each cavity comprises parallel upper 74 and lower 76 walls joined by lateral walls 78. These four walls extend along insertion axis C and define the inner socket volume of the cavity 16, in which the contact insert will be assembled and locked in place.

Lateral walls 78 separating two neighbouring cavities 16 are also referred to as partition walls.

Figure 7:
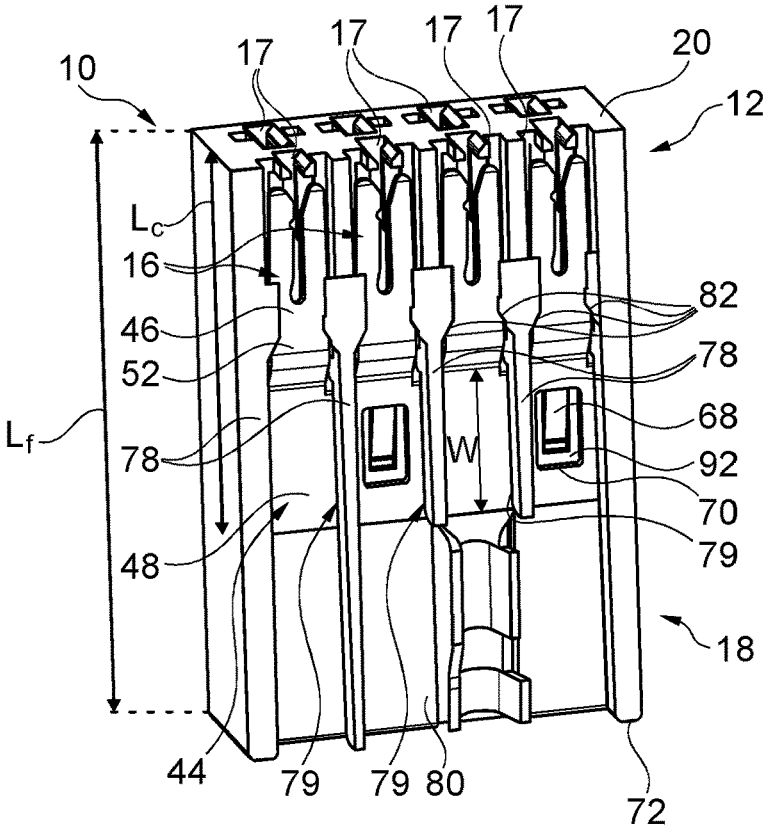
FIG. 7: is a cross-section view through the housing of FIG. 1, with a bus insert assembled therein.

FIG. 7 is a longitudinal section view though a plane passing through the middle of the first row of cavities (the cut plane indicated by line D in FIG. 2). One will recognise the four cavities 16 open at both axial ends, with, on the frontward section 12, the front side 20 with contact apertures 17. At the rearward section 18, it can be noticed that the cavities 16 do not extend along the whole length of the housing, but there is an inlet plenum 80 for accommodating the crimping section 62 of the bus insert 44. However, the individual cavities 16 are designed to extend on the rearward side over a length sufficient to receive most of the bus plate 48. This can be seen in FIG. 7, where the partition walls 78 extend from the front side 20 over the length of the terminals 46 and continue over the width W of the bus plate 48. In the present embodiment, one partition wall 78 (on the left) extends up to the rear side 72 of the housing 10.

As can be seen, when the bus insert 44 is properly assembled in the housing 10, it has its bus plate 48 maintained in a rear portion of the cavities 16, whereas the terminals 46 are each engaged in a front region of the respective cavities 16.

It will be noted that in order to accommodate the bus plate 48 in the rear portion of the cavities 16, each partition wall 78 is provided with a slot 79 extending from the rear end of the partition wall 78 and having a length corresponding to the width W of the bus plate. Furthermore, to reduce deflection of the bus plate 48, the width (in direction from the top to bottom wall) of this slot 79 corresponds to the thickness of the bus plate 48.

One may note reference sign 82 in FIG. 7, which indicates first locking features arranged on the partition walls 78 in the cavities 16 to cooperate with a single terminal insert 22 inserted in the cavity 16.

Figure 5:
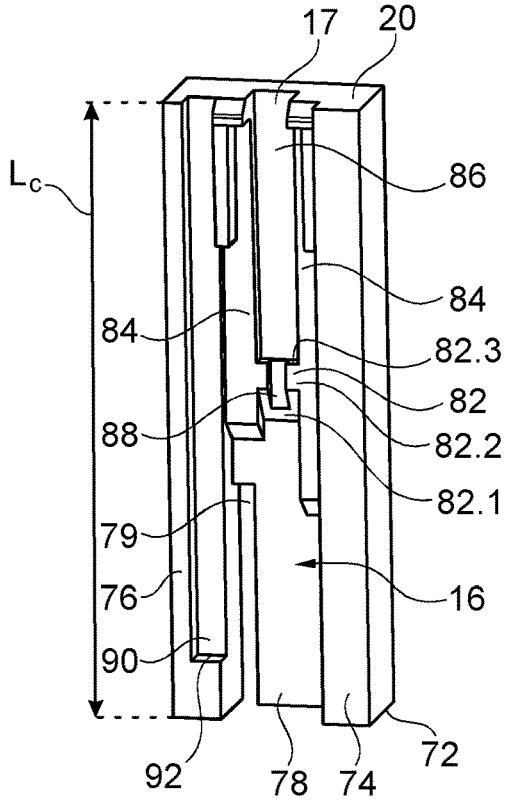
FIGS. 5 and 6: are longitudinal section views showing the interior of one cavity of the housing of FIG. 1.
Figure 6:
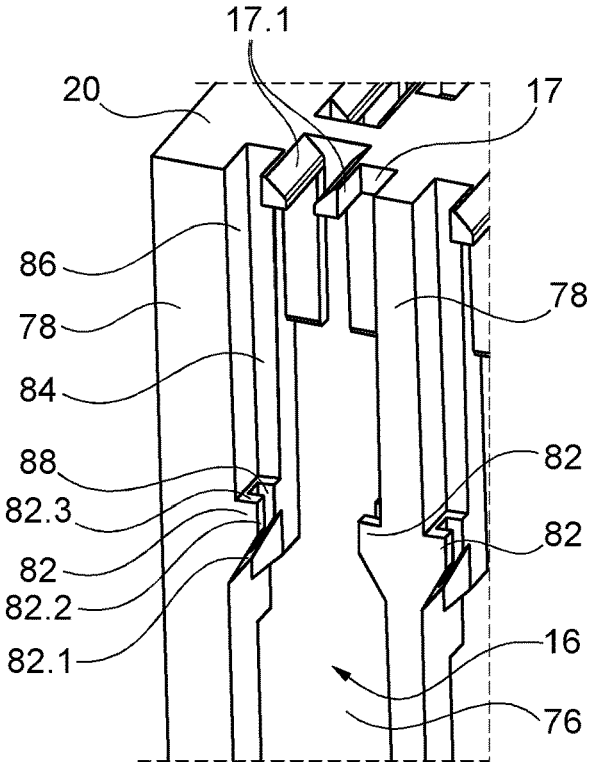

FIGS. 5 and 6 show the interior design of the cavity 16. One will recognise bottom wall 76, upper wall 74 and partition wall 78. Locking feature 82 is designed as a nose shaped protrusion on the partition wall 78. As apparent from FIG. 6, in the cavity 16 two locking protrusions 82 are facing each other and form a narrow section in the cavity. From the locking feature 82 up to the front 20 side, a flat protrusion 84 is provided on each side of the locking feature 82 to define a centring recess 86 for the single terminal insert 22.

The locking protrusion 82 defines, in the insertion direction C, an oblique surface 82.1 that leads to a flat part 82.2, here flush with the flat protrusions, and comprises a flat locking surface 82.3 extending substantially perpendicularly to the insertion direction C. The passage offered between the protrusions 82 essentially corresponds to the width of the cylinder 36 of single terminal insert 22, which can thus be pushed beyond the locking protrusions in the frontward section.

Reference sign 88 indicates an axial groove centrally arranged in the locking protrusion 82, which allows for the passage of the terminal 46 of the bus insert 44 into the frontward section 12. Furthermore, this groove 88 allows maintaining and centring the bus terminal 46 in the cavity. The width of groove 88 substantially corresponds to the thickness of the of terminal 46.

Figure 8:
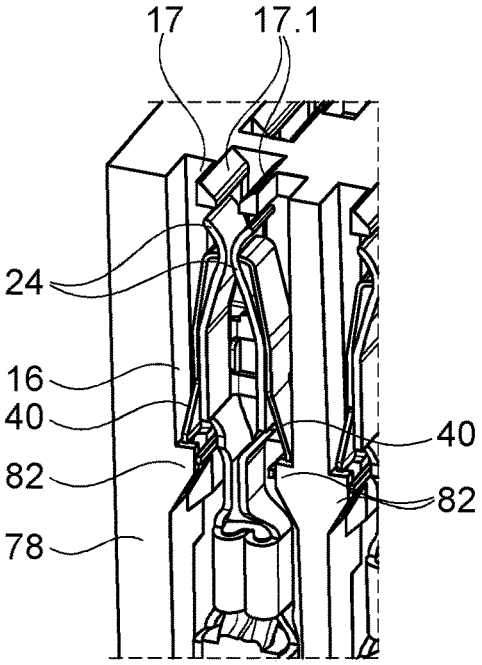
FIG. 8: is a cross-section view through one cavity of the housing of FIG. 1, with a single terminal insert assembled therein.
Figure 9:
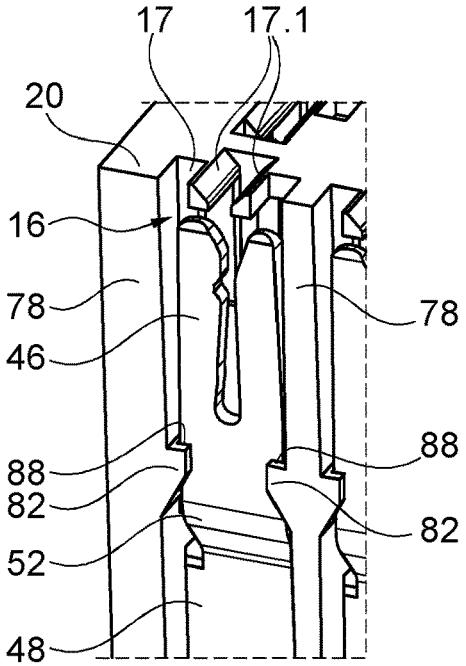
FIG. 9: is a detail view of FIG. 7 partly showing one cavity with a terminal of a bus insert therein.

The ability of the present design to accommodate single terminal inserts 22 and bus inserts 44 is further shown in FIGS. 8 and 9. Note that FIG. 8 only shows a cavity section of the housing, extending over length Lc of the housing, not full length Lf. Whereas the locking features 82 are designed as protrusions able to cooperate with the single terminal insert 22 to block it in place, the grooves 88 allow for the insertion of the terminals 46 of the bus insert 44. The bent intermediate section 52 is located between the bus plate 48 and the locking protrusions 82. From the assembly perspective, the bus insert 44 is introduced in the plenum 80 in such way that the terminals 46 are aligned with the cavities and the bus plate 48 is able to engage into the slots of the partition walls 78. The bus insert 44 is simply pushed axially (direction of axis X) until the terminals 46 and bus plate 48 are engaged in the cavities 16, as shown in FIG. 7. In such assembled position, the locking tabs 68 protrude outwardly and face a locking feature in the housing. This locking feature takes the form of a recessed area 90 with a transversal locking surface 92. In the assembled position of FIG. 7, the free end of locking tabs 68 each coincide with such recess 90 in the bottom wall and thus face a locking surface 92, preventing withdrawal of the bus insert from inside the housing.

When the bus insert 44 is introduced into the cavities 16, the bus plate 48 is in contact with the bottom wall 76. The resilient locking tabs 68 are forced into openings 70. When the bus insert 44 reaches the position of FIG. 7, the resilient locking tabs 68 are released and deploy inside the recess 90, facing the locking surface 92.

Regarding assembly of single terminal inserts 22, they are similarly introduced through plenum 80 but individually pushed into a respective cavity 16. As described above, the cylinder 36 has an external shape matching the cavity cross-section at the level of the locking protrusions 82. The design of the aperture 17 in the front side 20 includes here some wedge shaped guide walls 17.1 that facilitate the introduction of fuse terminals into the cavity 16. These guide walls further limit the progression of the single terminal inserts 22 in the front region of the cavities. During assembly, the female section 23 passes first the locking protrusions 82 and then the cylinder 36, which implies that the locking tabs 40 are forced into the openings 42 and re-deploy outwardly after passing the locking protrusions 82. This is the assembled configuration of FIG. 8, where the tabs 40 have their free end facing respective locking surfaces 82.3. The removal of the single terminal insert is thus prevented.

The locking tabs 40 and 68 provide a stable locking of the respective inserts in the housing. Preliminary tests show such locking tabscan withstand a pulling force of min. 120 N in any direction.

We claim:

1. An electrical connector housing, comprising:

an insulating housing body comprising a plurality of socket cavities configured to receive contact inserts of a first type or of a second type;

a forward section for connecting terminals of electrical components to the contact inserts arranged inside the housing; and an opposite rearward section from which said contact inserts are inserted into said cavities;

wherein:

at least one row of said socket cavities are formed as cylindrical cavities extending in the housing in parallel manner along an insertion direction running from the rearward to the forward section;

adjacent cavities in said row are separated by a partition wall;

the first type of contact insert comprises a single terminal insert formed as an elongate conductor designed to engage in a single socket;

the second type of contact insert comprises a bus insert comprising a number of spaced apart, parallel terminals extending from a bus plate, and configured so that said terminals engage in a corresponding number of sockets aligned in a row;

first locking means are provided in the socket cavities for locking in place a single terminal insert arranged in a given cavity;

second locking means are provided for locking in place athe bus insert inserted in a corresponding number of socket cavities; and said partition walls comprise, in the rearward section, slots extending in the insertion direction to accommodate the bus plate of the bus insert.

2. The electrical connector housing according to claim 1, wherein the first locking means comprise a plurality of protrusions arranged on opposite walls in the cavity and defining a substantially transversal locking surface facing frontward; and elastic tabs extending outwardly from the single terminal insert abut the locking surface when the single terminal is locked in place in said cavity.

3. The electrical connector housing according to claim 2, wherein an axially extending recess is formed along each of said opposite walls beyond said protrusions in the insertion direction for receiving and guiding said single terminal insert in the cavity.

4. The electrical connector housing according to claim 1, wherein said second locking means comprise a plurality of protrusions that include an axially extending groove through which said terminals of said bus insert are guided and extend towards the frontward section.

5. The electrical connector housing according to claim 4, wherein said groove has a width corresponding to a thickness of the bus plate.

6. The electrical connector housing according to claim 1, wherein the second locking means are located in the rearward section of the cavity.

7. The electrical connector housing according to claim 1, wherein the second locking means comprise a recess in a wall defining an abutment surface substantially perpendicular to the insertion direction that cooperates with a resilient locking tab protruding out from said bus plate.

8. The electrical connector housing according to claim 1, wherein the bus insert made from electrically conductive sheet metal and comprising:

a substantially rectangular bus plate having opposite longitudinal edges;

a number of spaced apart, parallel contact terminals extending from a first longitudinal edge of said bus plate, each terminal including an intermediate section connected at one end to the bus plate and at another end to a terminal section;

wherein the intermediate section of each terminal is bent out of a plane of the bus plate in such a way that the terminal sections of the terminals lie in a plane parallel to but spaced from the plane of the bus plate.

9. The electrical connector housing according to claim 8, comprising a connector section extending from a second longitudinal edge of said bus plate, the connector section being configured for securing an electric wire.

10. The electrical connector housing according to claim 9, comprising at least one resilient tab protruding outwardly from the bus plate, said resilient tab being connected at one end to said bus plate and having a free end extending outwardly in a direction of said second longitudinal edge over a corresponding aperture in said bus plate in which the tab can fit.

11. The electrical connector housing according to claim 8, wherein the terminal section of each terminal is U-shaped and comprises a pair of axially extending arms spaced by a groove, thereby forming a female connector section.

12. A kit of parts for an electrical connector comprising:

the electrical connector housing as claimed in claim 1;

at least one bus insert made from electrically conductive sheet metal and comprising:

a substantially rectangular bus plate having opposite longitudinal edges; and a number of spaced apart, parallel contact terminals extending from a first longitudinal edge of said bus plate, each terminal including an intermediate section connected at one end to the bus plate and at another end to a terminal section;

wherein the intermediate section of each terminal is bent out of a plane of the bus plate in such a way that the terminal sections of the terminals lie in a plane parallel to but spaced from the plane of the bus plate; and a plurality of single terminal inserts formed as elongate conductors configured to engage in a single socket cavity of said housing.

* * * * *